United States Patent [19]

Davidson

[11] 4,168,503

[45] Sep. 18, 1979

[54] ANTENNA ARRAY WITH PRINTED CIRCUIT LENS IN COUPLING NETWORK

[75] Inventor: Allen L. Davidson, Crystal Lake, Ill.

[73] Assignee: Motorola, Inc., Schaumburg, Ill.

[21] Appl. No.: 807,705

[22] Filed: Jun. 17, 1977

[51] Int. Cl.[2] ..... H01Q 3/26

[52] U.S. Cl. ..... 343/754; 343/854

[58] Field of Search ..... 343/754, 854, 853, 909

[56] References Cited

U.S. PATENT DOCUMENTS

| | | | |
|---|---|---|---|
| 3,293,648 | 12/1966 | Kuhn | 343/854 |
| 3,295,134 | 12/1966 | Lowe | 343/854 |
| 3,911,442 | 10/1975 | Hatch | 343/854 |
| 3,940,770 | 2/1976 | Fassett et al. | 343/854 |
| 3,971,125 | 7/1976 | Thies | 343/854 |

*Primary Examiner*—Eli Lieberman

*Attorney, Agent, or Firm*—Rolland R. Hackbart; James W. Gillman; James P. Hamley

[57] ABSTRACT

A radiated signal, received by each one of a plurality of spatially separated antennas, forming a directive array, is coherently recovered by the lens. The lens is comprised of a plurality of vertically standing and circularly arranged printed circuit panels, each of which includes a conductive strip connected at one end to each antenna. A plurality of semi-elliptical circuit panels are affixed to the vertical panels at a predetermined angle with respect thereto. Plated on the semi-elliptical panels are metal strips of predetermined length to provide the desired time delay to the antenna signals. A combining strip couples to the time delay strips and provides a combined output signal at one end of the semi-elliptical panel. The angle at which the semi-elliptical boards are affixed to the vertical boards corrects for time delay distortion caused by the placement of the combining strip.

11 Claims, 8 Drawing Figures

ANTENNA ARRAY WITH PRINTED CIRCUIT LENS IN COUPLING NETWORK

BACKGROUND OF THE INVENTION

The present invention pertains to the radio communication art and, more particularly, to a means for coherently recovering a signal received by an antenna array.

Various antenna lens assemblies have been developed for use in the radio communication art. A common application for a radio frequency lens is that of focusing a radio frequency signal received by a multiple antenna array. There, a signal impinging on the array strikes some antennas sooner than others due to the antennas spatial relationship. If the signals received by all antennas are to be combined, time coherency must be restored. It is the function of the lens to provide appropriate time delays to each antenna received signal whereby all signals may be combined in proper time and phase relationship.

The conventional prior art approach to providing the desired time delays is to pass the signals through links of cable serving as delay lines. Such systems have necessarily been costly, bulky and very inflexible. For example, in a multi sectored antenna array it is frequently necessary to alter the phasing relationship among the antennas to direct the array's radiation pattern in various directions. The prior art approach to providing this directive beam lens has included mechanical turntables which sequentially couple transmission lines to the various antennas to thereby provide the desired phasing. Such systems are bulky, costly and relatively unreliable in operation. Moreover, such prior art systems were not capable of both simultaneously beaming in various directions and providing the desired phase coherency.

Another prior art approach to radio frequency lens systems is the use of a transverse electromagnetic wave tuned cavity such as an RKR type lens. Here, antenna signals are fed to probes located within the cavity. The probe location, and the transmission characteristics of the cavity are such that proper combining occurs at receiving probes. Such cavity systems are costly to construct and do not generally require precision in some applications.

SUMMARY OF THE INVENTION

It is an object of this invention, therefore, to provide an improved lens assembly which requires no moving parts and is relatively small and inexpensive in construction.

It is a further object of the invention to provide the above described lens assembly which is capable of simultaneously providing coherent radiation patterns in various selected directions.

Briefly, according to the invention, the provided apparatus coherently combines a plurality of radio frequency (RF) signals, with each RF signal exhibiting a predetermined time delay. The apparatus comprises time delay circuitry which is adapted to receive each of the RF signals and output each signal with a predetermined time delay. The time delay provided by the time delay circuit is designed to compensate for the RF signals exhibited time delay. Combining circuitry combines all of the time delay signals from the time delay circuitry but, in the process, causes a predetermined time delay distortion to at least some of the time delay circuitry signals. Coupling means is provided which couples the RF signals from the antenna array to the time delay circuitry. Provided within the coupling means are means for predeterminedly time delaying selected RF signals to thereby compensate for the time delay distortion provided by the combining means. Thus, the combined output from the combining means is a time and phase coherent combined signal.

DETAILED DESCRIPTION OF THE PREFERRED EMBODIMENT OF THE INVENTION

Figure 1:
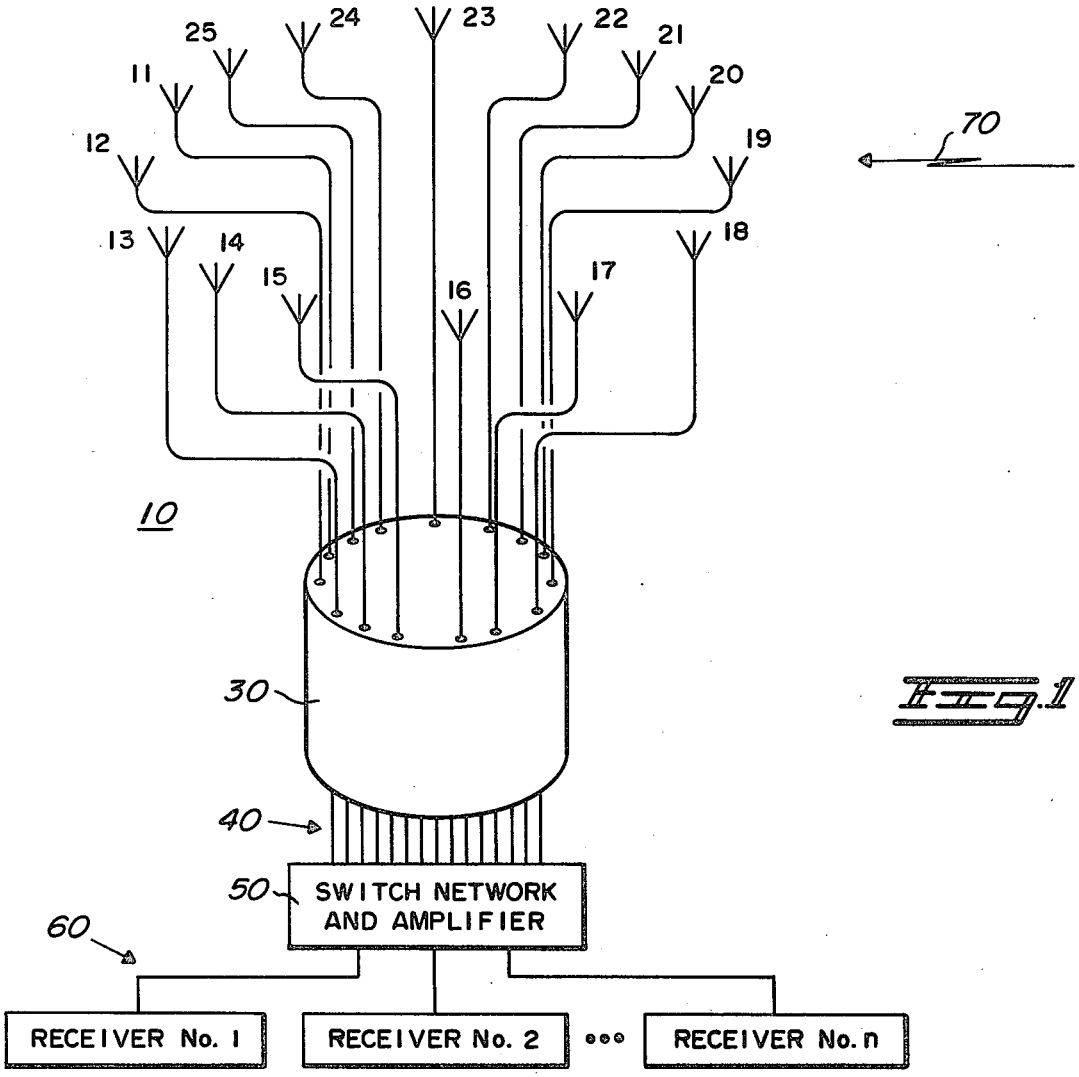
FIG. 1 illustrates application of the inventive lens used in combination with a multi-radiator antenna receiving system.

FIG. 1 illustrates a circular antenna array 10 comprising a circular arrangement of antenna radiators 11–25. Each antenna radiator 11–25 is coupled by suitable cabling to the lens 30. As is described more fully herein below, the lens coherently combines selected antenna radiators thereby providing the phase and time corrected combined signal at a plurality of output terminals 40. In the present embodiment of the invention employing 15 antenna sectors, the lens provides 15 output lines, each corresponding to an antenna radiation pattern beamed in any of 15 directions extending from the circular antenna array 10.

The output lines 40 couple to a switch network and amplifier 50. The switch network and amplifier 50 amplifies and routes a desired combined output provided by the output 40 to one or more of the receivers 60. The switch network 50 is capable of routing any given lens output 40 to any one or more of the receivers 60. Thus, each receiver might be receiving a beam coherent in a different direction from that being monitored by the remaining receivers. Alternatively, all receivers may monitor a signal from the same direction.

Figure 2:
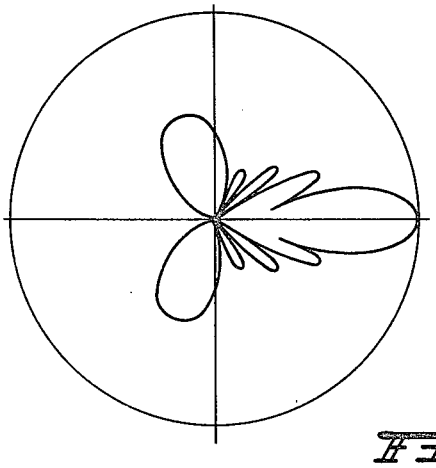
FIG. 2 illustrates the radiation pattern provided by the multi sectored array of FIG. 1.

In operation, the lens combines the signals received by five of the 15 antenna radiators, provides the appropriate time delay and power division to each, and combines the outputs thereby providing a coherent signal. FIG. 2 illustrates a radiation pattern produced by the time and phase coherent combining of the signals received by the five antenna sectors 17–21. This radiation pattern would be used for receiving a plane wave, such as plane wave 70 (FIG. 1) arriving from the indicated direction. Clearly, the plane wave 70 strikes antenna 19 prior to striking antennas 18, 20 or 17, 21. Thus, it is a function of the lens to provide the proper phase lag to the front located antenna, i.e. antenna 19, whereby when the signals from all antennas 17–21 are combined, the resultant signal is in proper phase coherency.

Figure 3:
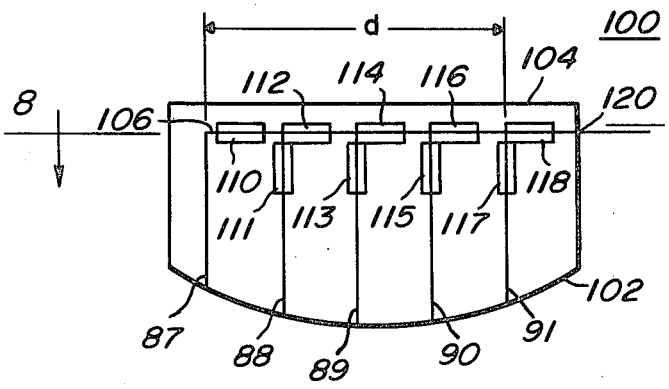
FIG. 3 illustrates a time delay panel according to the invention.
Figure 8:
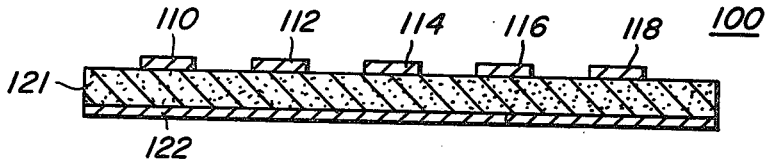
FIG. 8 is a cross-section taken along line 8—8 of FIG. 3.

FIG. 3 illustrates a time delay circuit panel 100 used in the inventive lens. Panel 100, a cross-section of which is shown in FIG. 8, is substantially semielliptical in shape having a perimeter portion 102 and a linear portion 104. In the preferred embodiment of the invention, panel 100 is a conventional high dielectric insulating material (121 in FIG. 8) which is suitable for depositing conductive strips thereon.

Five time delay strips 87–91, each having a predetermined length, are deposited on the panel 100 in such manner that one end of each strip extends to the perimeter portion 102 of the panel and the other extends towards the linear portion 104. The panel 100 illustrated in FIG. 3 is designed to compensate for the time and phase delays caused by the plane wave 70 (FIG. 1) impinging on the antenna elements 17–21. Thus, antenna elements 17–21 are connected to time delay strips 87–91, respectively. Time delay strip 89 is the longest of the metallized strips corresponding to the fact that the plane wave 70 is received by antenna 19 sooner than it is by the remaining antenna elements. Correspondingly, the line lengths of time delay strips 88 and 90 are longer than those of strips 87 and 91. Thus, the length of each strip 87–91 provides a precise time delay to each antenna received signal thereby re-establishing phase coherency.

Time delay strips 87–91 couple to a combining strip 106 which is substantially perpendicular to the delay strips 87–91. The coupling is provided through a series of matching sections 110–118 which both match each antenna element to the combining strip 106 and which provide power distribution to the signals received at each of the delay strips 87–91. The design of such matching sections 110–118 is well known to one of ordinary skill in this art. Well known matching sections are quarterwave transformers or directional couplers. For the case of the directional coupler, power division is provided by adjusting the coupling factor.

Hence, each antenna received signal, after suitable time delay due to time delay strips 87–91 is combined with the remaining signals on the combining strip 106. The combined output signal is provided by the combining strip output at terminal 120. It is desirable to take the output from the time delay panel 100 at one edge thereof to provide a convenient means of connection. However, due to the fact that the combining strip output terminal 120 is a varying distance from each of the time delay strips 87–91 a time delay distortion is produced. Thus, for example, since the signal from time delay strip 87 must traverse the distance d greater than the signal from time delay strip 91 before reaching the combining output terminal 120, the signal from time delay strip 87 suffers a time delay, corresponding to the length d, thereby destroying the desired phase coherency. It should be clear that there are corresponding delays caused by the spatial relationships between the remaining strips 88, 89, 90 and 91.

Figure 4:
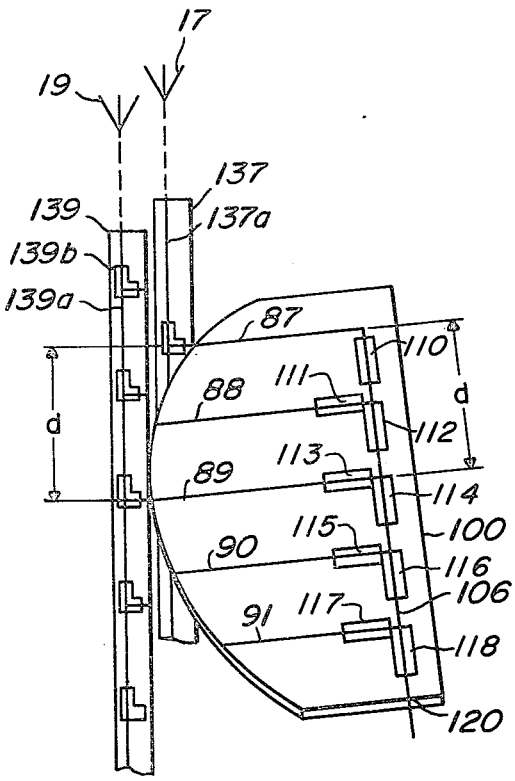
FIG. 4 illustrates the time delay panel of FIG. 3 shown in combination with the vertical coupling strips.
Figure 7:
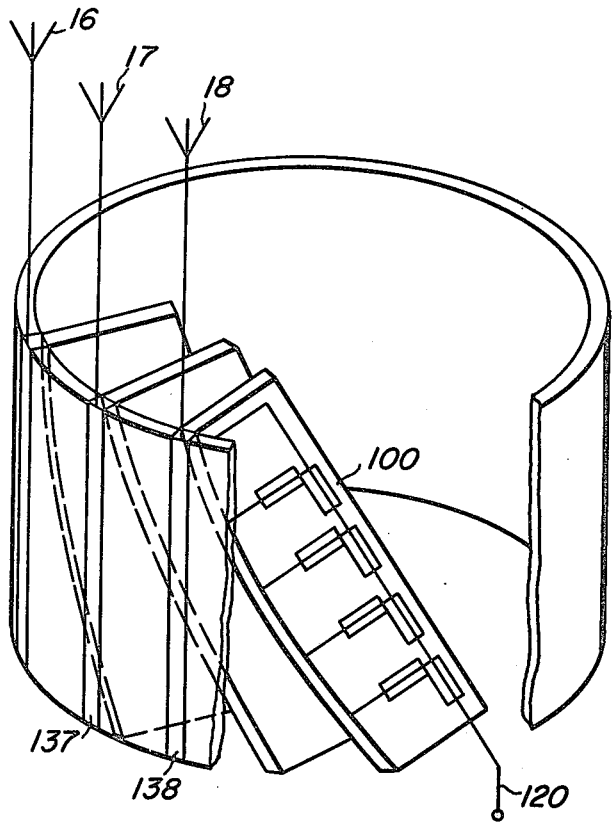
FIG. 7 illustrates in more detail the arrangement of the time delay panels and vertical coupling boards of FIG. 5.

FIG. 4 illustrates the preferred embodiment of the means to compensate for the time delay distortion introduced by the combining strip. Here, the time delay panel 100, along with its time delay strips 87–91 and output portion 120, is shown affixed at a diagonal with respect to a pair of vertically standing coupling boards 137, 139, each coupling board having a metallized strip **137*a*, 139*a* formed thereon for coupling signals from a corresponding antenna radiation 17, 19, respectively. Provided on each coupling board are matching sections, one of which being indicated at 139*b*, which provide impedance matching and power division to signals on the strips. It should be understood that whereas FIG. 4 illustrates only two coupling strips 137, 139, coupling strips from other antenna sectors, such as sectors 18, 20 and 21 have been deleted for purposes of drawing clarity. The arrangement of several coupling boards and time delay panels 100 is illustrated in FIG. 7**.

Due to the diagonal placement of delay panel 100 with respect to the coupling boards 137, 139 the signal from antenna sector 19 traverses an additional distance d as compared with that of antenna 17, before being coupled to its time delay strip 89. Thus, for the case wherein the coupling board 139 provides the same time delay per unit length as does the combining strip 106, the extra time delay provided by the coupling board 139 will precisely compensate for the time delay distortion provided by the combining strip 106. Where the time delay transmission characteristics of the coupling boards 137, 139 are different from that of the combining strip 106, the diagonal placement of the time delay panel 100 with respect to the coupling boards 137, 139 may be correspondingly adjusted to provide the desired compensation. Thus, due to the configuration of the coupling boards, the resultant output at the combining output terminal 120 provides the precisely coherent combined signal from the antenna sectors.

Grounding for the system is provided by plating the opposite sides of the diagonal boards and vertical coupling boards with a conductive material, such as copper, and electrically interconnecting the grounding portions (122 in FIG. 8) from all boards.

The output at combining output terminal 120 thus provides the focusing required to realize the radiation pattern illustrated in FIG. 2.

Figure 5:
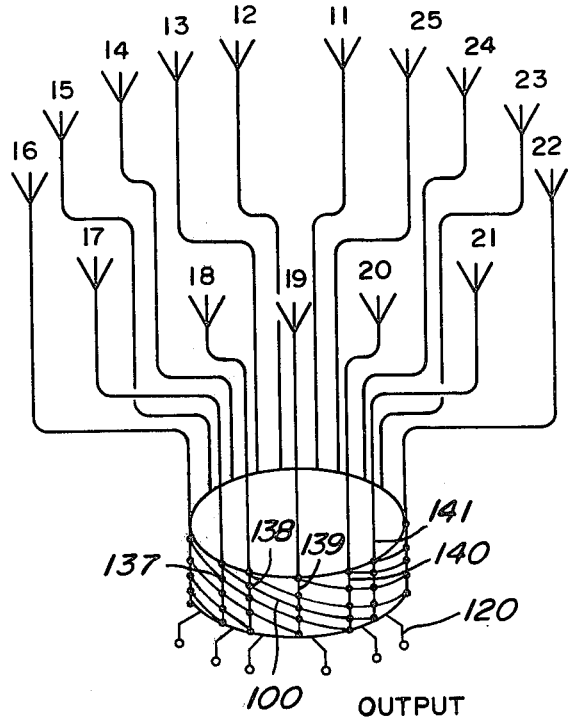
FIG. 5 illustrates the preferred construction of the lens apparatus in a drum configuration.

FIG. 5 illustrates the preferred embodiment of the lens apparatus in a drum configuration. Here, a diagonal panel 100, and a vertical coupling board 137–141 is provided for each antenna element. For example, referring to FIG. 4, the time delay circuit panel 100 is shown in position connected to appropriate portions on vertical boards 137–141. The output portion from the diagonally located time delay panel 100 is provided at output terminal 120.

Figure 6:
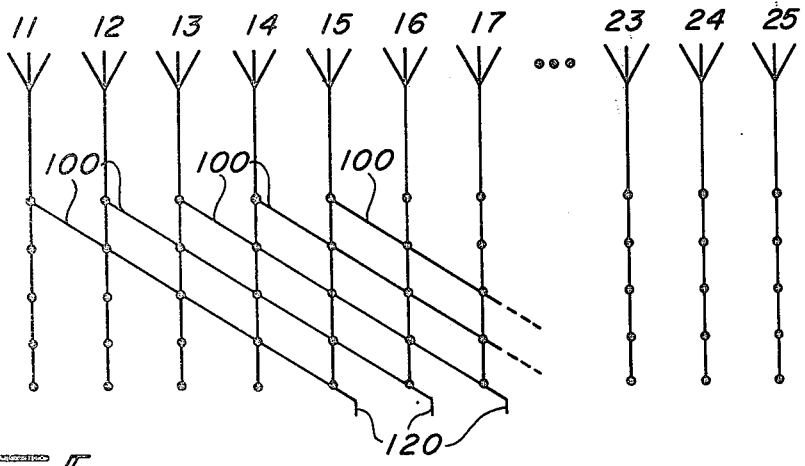
FIG. 6 illustrates, in planar form, the preferred embodiment of the drum shaped antenna lens.

The drum configuration of FIG. 5 may be more easily understood with reference to FIG. 6 which illustrates the electrical configuration of the drum when unrolled into planar form. Each antenna is shown feeding through one of the vertical boards. Taps off the vertical boards in turn feed the inputs to the diagonal panels 100. Since the diagonal panels 100 are located at a diagonal with respect to the vertical boards, the overall line length from antenna to lens output may be selected to compensate for the fact that the output from each diagonal panel 100 is at one end, output terminal 120, i.e. to compensate for the aforementioned time delay distortion.

Since the lens may be fabricated out of printed circuit materials it is easy to manufacture yet precise in operation. Moreover, the inventive lens may be provided in relatively small structure, which structure requires no movable parts but which nonetheless, provides a plurality of simultaneous coherent outputs.

While a preferred embodiment of the invention has been described in detail, it should be apparent that many modifications and variations thereto are possible, all of which fall within the true spirit and scope of the invention.

I claim:

1. Apparatus for phase coherently combining a plurality of radio frequency (RF) signals, each RF signal exhibiting dissimilar first predetermined time delays, said apparatus comprising:

time delay means adapted to receive and provide a second predetermined time delay to each RF signal, the second predetermined time delay compensating for the first predetermined time delay of each RF signal, said time delay means comprising a circuit panel having located thereon a series of metallized strips, each strip of predetermined dimension and adapted for receiving a selected one of said RF signals at an input portion, said strips providing said predetermined time delay to said signal and outputting said time delayed signals at an output portion;

combining means for combining the signals from the time delay means to provide a combined signal, said combining means introducing a predetermined timing distortion to at least some of the signals from the time delay means; and coupling means for coupling the RF signals to said time delay means, the coupling means including means for predeterminedly time delaying the RF signals to compensate for the corresponding timing distortion introduced by the combining means.

2. The apparatus of claim 1 wherein the combining means comprises a metallized combining strip on said circuit panel, said combining strip coupled to the output portion of each time delay means metallized strip to couple the signal therefrom, said combining strip including an output portion for producing said combined signals thereat, said output portion being a predetermined distance from each of said time delay means metallized strip output portions thereby introducing the time delay distortion.

3. The apparatus of claim 2 wherein the coupling means comprises a plurality of conductive coupling strips for coupling said RF signals to said time delay means, each coupling strip of predetermined length to compensate for said time delay distortion introduced by the combining means.

4. A radio frequency (RF) lens assembly adapted for phase coherently combining RF signals received by an antenna array, wherein a RF signal received by each antenna has a predetermined time delay relationship with respect to other antenna array signals due to the spatial relationship between the antennas, the lens assembly comprising:

time delay means including means adapted to receive and predeterminedly time delay each one of the antenna array received signals to compensate for time delays caused by the spatial relationship of the antenna array, said time delay means comprising a circuit panel having located thereon a series of metallized time delay strips, each strip of predetermined dimension and adapted for receiving a selected one of said RF signals at an input portion, each strip providing said predetermined time delay to said signal and outputting said time delayed signal at an output portion;

combining means for combining the signals from the time delay means to provide a combined signal, said combining means introducing a predetermined timing distortion to at least some of the signals from the time delay means; and coupling means for coupling each of the antenna array received signals to the time delay means, the coupling means including means for predeterminedly time delaying the RF signals to compensate for the corresponding timing distortion introduced by the combining means;

whereby the combined signal from the combining means is phase coherent.

5. The lens assembly of claim 4 wherein the combining means comprises a metallized combining strip on said circuit panel, said combining strip coupled to the output portion of each time delay strip to couple the signal therefrom, said combining strip including an output portion for producing said combined signals thereat, said output portion being a predetermined distance from each of said time delay strip output portions thereby introducing the time delay distortion.

6. The lens assembly of claim 5 wherein the coupling means comprises a plurality of conductive coupling strips for coupling said antenna received RF signals to said time delay means, each coupling strip of predetermined length to compensate for said time delay distortion introduced by the combining means.

7. The lens assembly of claim 4 wherein said time delay circuit panel is substantially semi-elliptical in shape with each time delay strip deposited thereon having its input portion extending to the perimeter of the semi-elliptical panel and having its output portion extending towards the linear portion of the semi-elliptical panel.

8. The lens assembly of claim 7 wherein the combining means comprises a combining strip deposited on said semi-elliptical panel such that it couples with, and is substantially perpendicular to, said time delay strips with the combined output portion extending to one end of said panel.

9. The lens assembly of claim 8 wherein the coupling means comprises a plurality of coupling panels, each coupling panel having deposited thereon a conductive coupling strip for coupling said antenna received information signals to said time delay means, with each coupling strip of predetermined length to compensate for said time delay distortion introduced by the combining means, with one end of each coupling strip coupled to each antenna and the remaining end of each coupling strip coupled to the input portion of each time delay strip at the perimeter of the semi-elliptical panel.

10. The lens assembly of claim 9 wherein a ground plane is provided on the sides of the semi-elliptical panels and the coupling panels opposite the sides having the time delay strips and the coupling strips, respectively.

11. The lens assembly of claim 9 wherein a semi-elliptical panel is provided for each antenna and wherein each semi-elliptical panel is affixed in an angled relationship with respect to the coupling strips such that the input portions of the time delay strips couple to the appropriate length of the coupling strip to compensate for said time delay distortion.

* * * * *